US005692678A

United States Patent [19]

Ishibashi et al.

[11] Patent Number: 5,692,678

[45] Date of Patent: Dec. 2, 1997

[54] FLAME SPRAYING BURNER

[75] Inventors: Genichi Ishibashi; Kuniaki Sato; Hiroyuki Nakashima; Keiji Matsuda; Satoshi Shimizu; Seiji Watanabe, all of Chiba, Japan

[73] Assignee: Kawasaki Steel Corporation, Hyogo, Japan

[21] Appl. No.: 432,942

[22] Filed: May 1, 1995

[51] Int. Cl.[6] ..... B05B 1/24

[52] U.S. Cl. ..... 239/80; 239/425

[58] Field of Search ..... 239/79, 80, 425

[56] References Cited

U.S. PATENT DOCUMENTS

| | | | |
|---|---|---|---|
| 3,558,063 | 1/1971 | Goff | 239/425 |
| 4,065,057 | 12/1977 | Durmann | 239/79 |
| 4,526,322 | 7/1985 | Voorheis | 239/425 X |
| 4,646,968 | 3/1987 | Sablatura | 239/79 X |
| 4,712,998 | 12/1987 | Conrad | 239/425 X |
| 5,580,237 | 12/1996 | Leger | 239/425 X |

FOREIGN PATENT DOCUMENTS

| | | | |
|---|---|---|---|
| 4015009 | 10/1991 | Germany | 239/79 |
| 55-111861 | 8/1980 | Japan . | |
| 56-118763 | 9/1981 | Japan . | |
| 16114 | 1/1983 | Japan | 239/425 |
| 59-58058 | 4/1984 | Japan . | |
| 59-58059 | 4/1984 | Japan . | |
| 59-60178 | 4/1984 | Japan . | |
| 61-13299 | 1/1986 | Japan . | |
| 61-13300 | 1/1986 | Japan . | |
| 1607968 | 11/1990 | U.S.S.R. | 239/425 |
| 82/02244 | 7/1982 | WIPO | 239/425 |

*Primary Examiner*—Lesley D. Morris
*Attorney, Agent, or Firm*—Oliff & Berridge

[57] ABSTRACT

A flame spraying burner melts or partially melts with combustion heat, a spray material comprising a powdered fire-resisting material to thermally spray a damaged portion of a furnace wall or the like. The flame spraying burner includes a burner nozzle body having a central passage for supplying oxygen-contained gas, the central passage having a projecting leading end, and a plurality of fuel gas supply passages formed around the central passage. Each of the plurality of fuel gas supply passages has a leading end recessed from the leading end of the central passage. A cylindrical burner tile is positioned around the leading end of the fuel gas supply passages and extends to at least the leading end of the central passage. A plurality of oxygen jetting ports are formed in the radial direction around the leading end of the nozzle cap.

8 Claims, 7 Drawing Sheets

FLAME SPRAYING BURNER

BACKGROUND OF THE INVENTION

1. Field of the Invention

This invention relates to a burner that thermally sprays molten or half molten fire-resisting material in the form of powder on a damaged portion of a wall of an industrial furnace or a wall of a container to repair the damaged portion. More particularly this invention is directed to a burner that is satisfactorily usable in a narrow space.

2. Related Art

An inner wall of an industrial furnace (such as, for example, a coke oven, a converter or a degasification chamber) used, for example, in a steel manufacturing plant, accommodates molten material, such as, for example, molten iron, molten steel, slag or coal for dry distillation. The inner wall of the furnace is usually subjected to temperatures not lower than 1,000° C. In particular, the temperature of the inner wall changes significantly when the molten material is injected, stored or discharged. Therefore, damage to the inner wall occurs such as, for example, cracks or separation. In addition, fusing damage due to infiltration of the molten material can occur as well.

A so-called wet blast repair method has been conventionally used in an attempt to repair the inner wall. In the wet blast repair method, a slurry-shape fire-resisting material is blasted onto the inner wall by a carrier gas. To improve the efficiency of the repair operation, a so-called dry thermal spray repair method has conventionally been widely employed in recent years. In the dry thermal spray repair method, a repair material is sprayed in a hot state onto a damaged portion of a fire-resisting portion. The dry thermal spray repair method usually includes the steps of mixing combustible material with a powdered fire-resisting material, supplying a combustion-enhancing gas to generate a combustion flame, using the heat of the flame to melt or partially melt the fire-resisting material, and rapidly spraying the fire-resisting material onto the damaged portion of the inner wall. Therefore, the dry thermal spray repair method has advantages over the conventional wet blast repair method. The sprayed fire-resisting material is able to maintain its fire-resisting quality when it is sprayed. Additionally, the lifetime of the repaired portion is superior to the repair lifetime realized by the conventional wet blast repair method.

However, since the dry thermal spray repair method includes the step of spraying the completely or partially melted powdered fire-resisting material, a burner is an essential element of this method. Therefore, the burner must have a predetermined characteristic such that the fuel gas and powder are uniformly distributed as they are sprayed. The shape of the flame must be formed to meet the object of the repair, and burner must have a long lifetime. In recent years, burners of the following type have been intensely studied.

Several burners are disclosed in Japanese Laid-Open Patent No. 55-111861, Japanese Laid-Open Patent No. 56-118763, Japanese Laid-Open Patent No. 59-60178, Japanese Laid-Open Utility Model No. 59-58058, Japanese Laid-Open Utility Model No. 59-58059, Japanese Laid-Open Utility Model No. 61-13299 and Japanese Laid-Open Utility Model No. 61-13300.

A typical example of these conventional burners, particularly the burner disclosed in Japanese Laid-Open Patent No. 59-60178, is shown in FIG. 8. In FIG. 8, a fuel and spray material supply passage 23 is formed on the central axis of a burner 20. A cavity 22 having the form of a right circular frustoconical polyhedron is formed in front of the supply passage 23. A plurality of combustion-enhancing, gas jetting-out ports 24 are formed in the cavity 22. An annular combustion-enhancing, gas supply passage 33 is formed around the fuel and spray material supply passage 23. The combustion-enhancing, gas supply passage 33 communicates with the combustion-enhancing, gas jetting-out ports 24. A water-cooling jacket 18 is positioned at an outermost portion of the burner around the combustion-enhancing gas supply passage 33.

The conventional burners disclosed in the other above-identified references have similar structures. Each of these burners has a structure such that a fuel and spray material supply passage or a spray material supply passage is formed in the central portion of the burner. The combustion-enhancing, gas supply passage is formed around the supply passage, or, alternately, the fuel gas supply passage and the combustion-enhancing gas supply passage are individually formed around the supply passage. The combustion-enhancing gas and the fuel gas are connected, through passage pipes or jetting-out ports, to the supply passage 23 formed in the central portion of the burner. Each of the passage pipes or jetting-out ports makes an angle θ with the supply passage 23.

When the above-described conventional burners are used to repair a narrow space in, for example, an immersion pipe for degasification, or the wall of a coke oven, several problems arise. First, the flame length is limited to a very short length of, for example, about 200 mm to 300 mm. In order to decrease the velocity at which the sprayed powdered fire-resisting material collides with the interior wall and to prevent rebound loss of the sprayed material, the flame of the burner must be widened. Therefore, the burner must meet strict conditions.

However, when the flame length of the burner is shortened by enlarging the angle θ of each port through which oxygen is inwardly discharged from outside, the combustion point cannot be stabilized. If an appropriate angle θ at which the flame is stable is selected, the flame lengthens excessively, to 300 mm or longer. Furthermore, when oxygen is inwardly supplied from outside of the fuel gas passage, an elongated and jetting type flame is inevitably formed. This raises the collision velocity of the sprayed material toward the furnace wall. Thus, excessive rebound loss of the sprayed material cannot be prevented. Although this conventional burner is suitable when used in a wide space, it cannot be satisfactorily used in a narrow space.

SUMMARY OF THE INVENTION

This invention therefore provides a burner capable of generating a short, hot and wide flame.

This invention further provides a flame spraying burner for use in an industrial furnace that exhibits an excellent efficiency and a satisfactory operation efficiency.

As described above, the conventional burners are structured such that a fuel and spray material supply passage is formed in a central portion of the burner. A combustion-enhancing gas supply passage is formed around the fuel and spray material supply passage. On the other hand, the burner of this invention includes a combustion-enhancing gas supply passage formed in a central portion of the burner. Furthermore, fuel and spray material supply passages are formed around the combustion-enhancing gas supply passage.

According to preferred embodiments of this invention, a flame spraying burner melts or partially melts, with combustion heat, a spray material mainly comprising a powdered fire-resisting material to thermally spray a damaged portion of a furnace wall or the like. The flame spraying burner includes a burner nozzle body having a projecting leading end. The nozzle body has a central passage for supplying oxygen-containing gas and a plurality of fuel gas supply passages formed around the central passage. The leading end for each of the plurality of fuel gas supply passages is recessed from the leading end of the central passage. A cylindrical burner tile is positioned around the leading end of the fuel gas supply passages and extends to at least the leading end of the central passage. The leading end of the central passage is closed and a plurality of oxygen jetting-out ports are formed circumferentially around the leading end of the central passage. The leading end of the central passage may include a nozzle cap having second oxygen-jetting-out ports formed in the nozzle cap and disposed at the leading end of the central passage. Therefore, the length and width of the flame can be easily changed by merely changing the nozzle cap. As a result, a short, hot and wide flame can be formed.

Since the burner includes the nozzle cap having the plurality of the second oxygen-jetting-out ports formed in its leading end portion, a stable combustion flame can be formed, regardless of the flow rate of the oxygen gas and the fuel gas. Thus, the deposition efficiency with respect to the repair portion can be improved. Since the burner of this invention enables the jetted fuel gas to be supplied with oxygen over all cross sections, generation of hot spots due to local combustion is prevented. Furthermore, clogging of the burner, caused by the fire-resisting material melting within the burner, can be prevented.

Other and further objects, features and advantages of the invention will be appear more fully from the following description.

BRIEF DESCRIPTION OF THE DRAWINGS

The invention will be described in conjunction with the following drawings in which like reference numerals designate like elements and wherein.

DESCRIPTION OF THE PREFERRED EMBODIMENTS

Figure 1A:
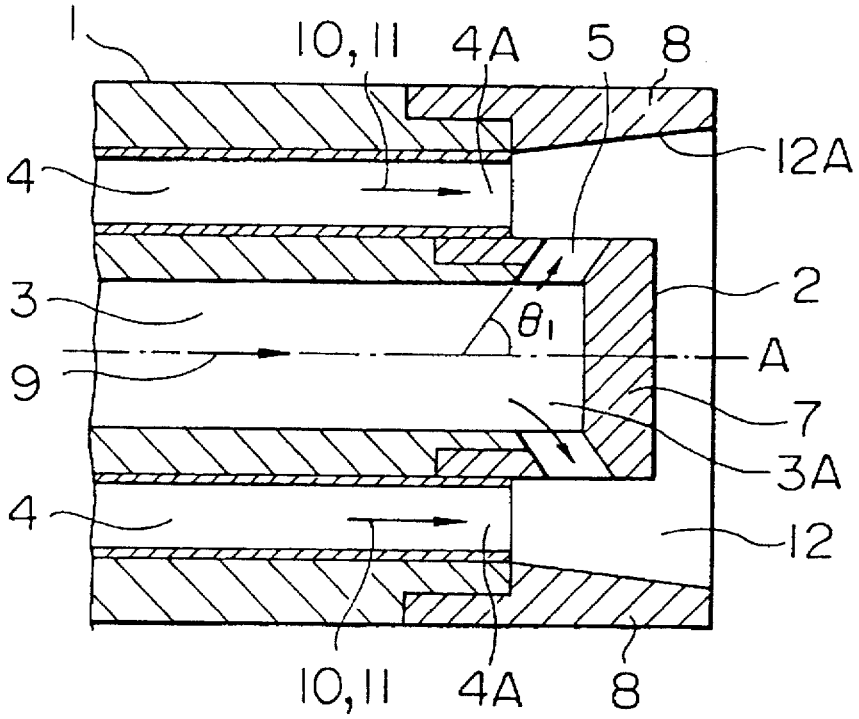
FIG. 1A is a side cross sectional view of a first preferred embodiment of the burner of this invention.
Figure 1B:
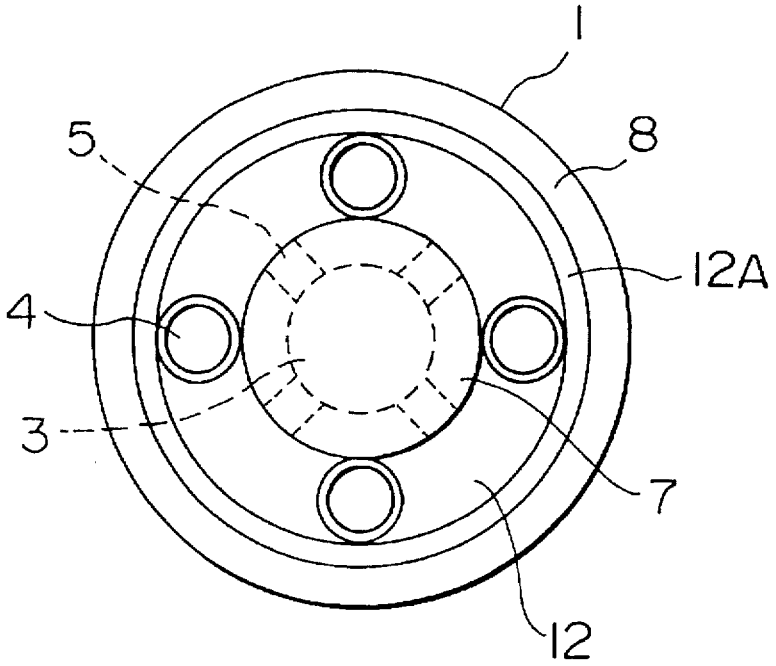
FIG. 1B is a front plan view of the first preferred embodiment of the burner.

FIG. 1A is a side cross sectional view and FIG. 1B is a front plan view of a first preferred embodiment of a burner 1. The burner 1 includes a burner nozzle body 2. The burner nozzle body 2 includes a central passage 3 and a plurality of fuel-gas supply passages 4. The central passage 3 supplies an oxygen-containing gas 9. A plurality of fuel-gas supply passages 4 are formed circumferentially around the central passage 3. The leading end 4A of each fuel-gas supply passage is recessed or set back relative to the leading end 3A of the central passage 3. The fuel-gas supply passages 4 supply a fuel gas 10 and fire-resisting powder 11.

Preferably, the burner nozzle body 2 is an integrally-molded body, and the body 2 is preferably formed from ceramics or a fire-resisting alloy material. Alternatively, the body 2 may be formed from a plurality of tubular members. The leading end 3A of the central passage 3 extends beyond the passages 4 and is closed. A plurality of first oxygen-jetting ports 5 are formed in a nozzle cap 7 for jetting out the oxygen-containing gas 9 radially from the central passage 3 into the nozzle cavity 12 of a burner tile 8. The leading end 3A is closed by a nozzle cap 7. The nozzle cap 7 and the outer end portion of leading end 3A of the central passage 3 are threaded to allow the nozzle cap 7 to be easily attached and detached from the leading end 3A of the central passage 3. The cylindrical burner tile 8 is positioned around the leading ends 4A of the passages 4. The burner tile 8 has a length extending beyond at least the end 3A of the central passage 3.

The fuel gas 10 and the fire-resisting powder 11 are jetted out from the leading ends 4A of the supply passages 4 into the nozzle cavity 12. The fuel gas 10 and the fire-resisting powder 11 flow along an inner wall 12A of the nozzle cavity 12 of the burner tile 8 toward a damaged portion of a furnace or the like to be repaired. The oxygen-containing gas 9, which is a combustion-enhancing gas, is supplied through the central passage 3 of the burner nozzle body 2. The oxygen-containing gas 9 is jetted out through the first oxygen-jetting ports 5 in a radial direction. Thus, the oxygen-containing gas 9 traverses the nozzle cavity 12, in which the fuel gas 10 and the fire-resisting powder 11 are present, and collides with the inner wall 12A of the burner tile 8. As a result, the fuel gas 10 is surrounded by the oxygen-containing gas 9, such that the gases 9 and 10 are uniformly mixed with each other. In this first preferred embodiment, the number of first oxygen-jetting ports 5 for supplying the oxygen-containing gas 9 is not particularly limited. However it is preferable that the number of first oxygen-jetting ports 5 be equal to the number of supply passages 4. Furthermore, the first oxygen-jetting ports 5 are preferably formed at intermediate positions between the positions of the adjacent passages 4 for supplying the fuel gas 10, as shown in FIG. 1B.

When the oxygen-containing gas 9 is discharged through the first oxygen-jetting ports 5 and collides with the inner wall 12A of the burner tile 8, the oxygen-contained gas 9 is efficiently mixed with the fuel gas 10 discharged from the supply passages 4. Furthermore, since the mixture is enhanced in the circumferential direction, a short flame can be formed. Therefore, the first burner 1 has a significant advantage in heating and dissolving substances when a short flame is required. Furthermore, if the fire-resisting powder 11, which can include a metal powder, is mixed with the fuel gas 10, the burner 1 can be satisfactorily used to repair a fire-resisting portion by the thermal spray method when performed in a narrow space. Additionally, the mixture of the fire-resisting powder 11 or the like with the fuel gas 10 can be performed in a region between a hopper and the leading ends 4A of the passages 4 by a known means. Therefore, the structure for mixing is omitted from illustration.

When the burner 1 is used in a repair operation by thermally spraying the fire-resisting material 11, the collision velocity of the fire-resisting material 11 toward a damaged portion of the furnace wall or the like can be decreased and the rebound loss of the sprayed material can be reduced by changing the flame from a thin shape to a wide shape. In this first preferred embodiment of the burner 1, the first oxygen jetting ports 5, while extending radially from the central passage 3 to the cavity 12, makes an angle $\theta_1$ with the longitudinal axis A of the burner 1. The burner 1 of this invention enables the flame shape to be arbitrarily changed by changing the angle $\theta_1$ of each of the first oxygen-jetting ports 5. When $\theta_1$=45°, the widest flame is formed, and when $\theta_1$=90°, a thin flame can be formed. Specifically, a variety of nozzle caps 7, each having a different angle $\theta_1$, can be easily attached and detached from the leading end 3A of the central passage 3. Accordingly, the burner 1 can be adapted based on the location where the burner 1 is to be used. The angle $\theta_1$ is limited to the range between 45° to 90°. When the angle $\theta_1$ is smaller than 45°, the burner tile 8 must be lengthened excessively. This prevents the burner from being insertable into a narrow space to perform the thermal spray. When the angle $\theta_1$ is greater than 90°, counterflow of the oxygen-containing gas 9 back into the passages 4 occurs, and the flame cannot be stabilized.

Figure 2A:
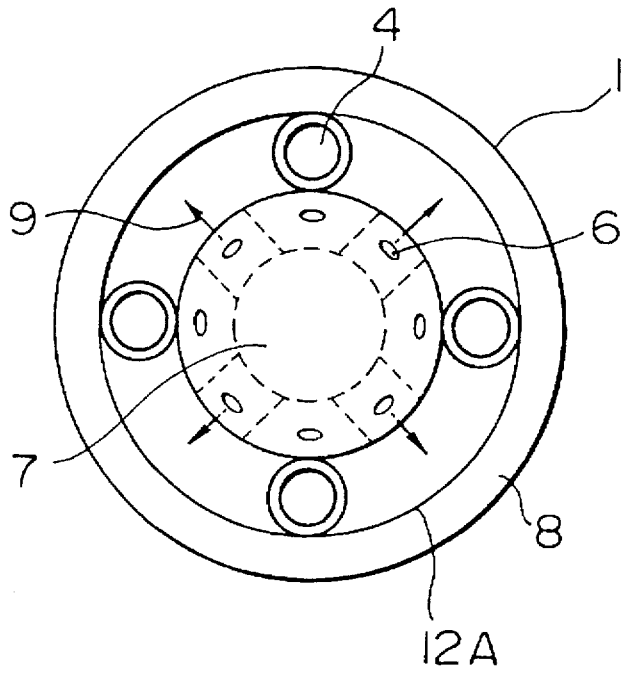
FIG. 2A shows a front plan view of a second preferred embodiment of the burner of this invention.
Figure 2B:
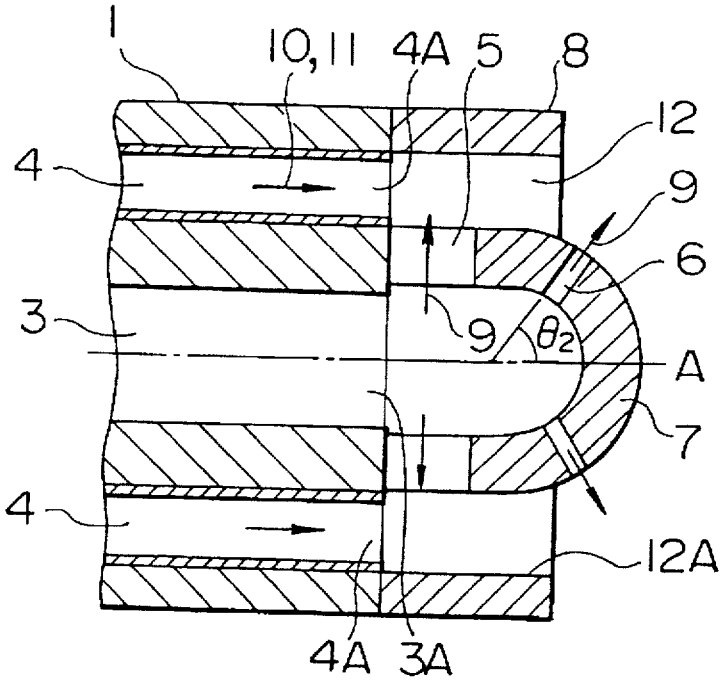
FIG. 2B is a side cross sectional view of the second preferred embodiment of the burner.

In the second preferred embodiment shown in FIGS. 2A and 2B, the nozzle cap 7 is provided with second oxygen-jetting ports 6 for jetting out the oxygen-contained gas 9 into the fuel flame. A plurality of the first oxygen-jetting ports 5 are formed in the nozzle cap 7. A plurality of the second oxygen-jetting ports 6 are formed in the nozzle cap 7. The nozzle cap 7 and the outer end portion of the leading end 3A of the central passage 3 are threaded to allow the nozzle cap 7 to be easily attached and detached from the leading end 3A of the central passage 3. By supplying the oxygen-contained gas 9 through the second oxygen-jetting ports 6, the shape of the combustion flame and the jetting angle of the molten fire-resisting material 11 can be adjusted.

Figure 3A:
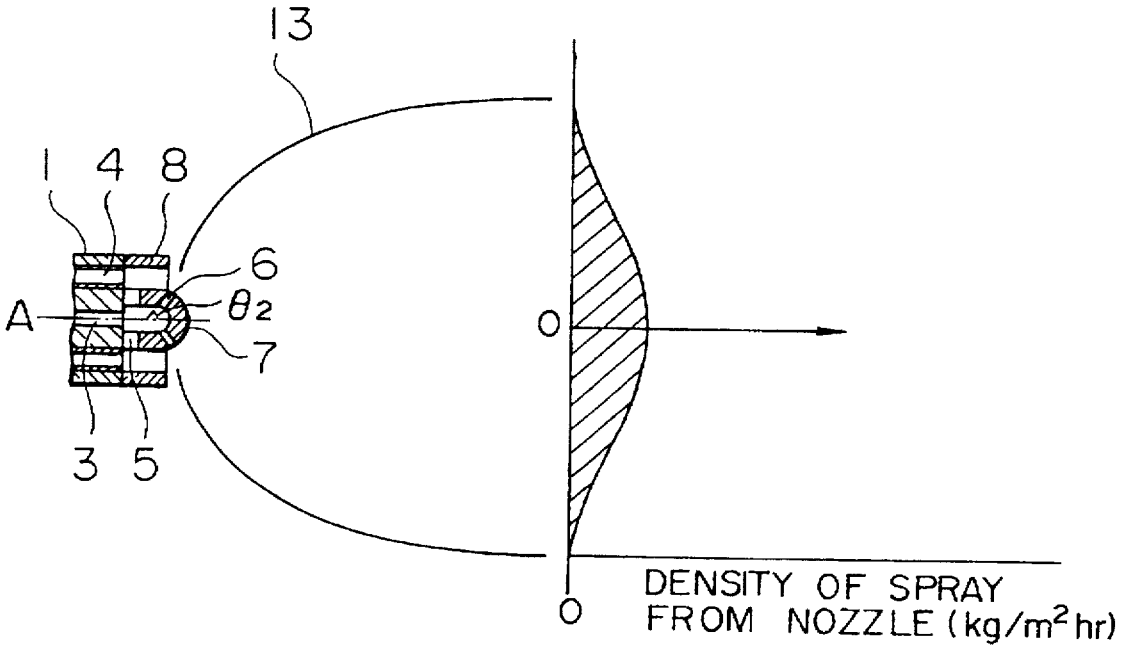
FIG. 3A shows the relationship between the flame shape, the density of the material as it is sprayed from the nozzles, and the angle $\theta_2$ of the second oxygen-jetting ports when $\theta_2$ is large.
Figure 3B:
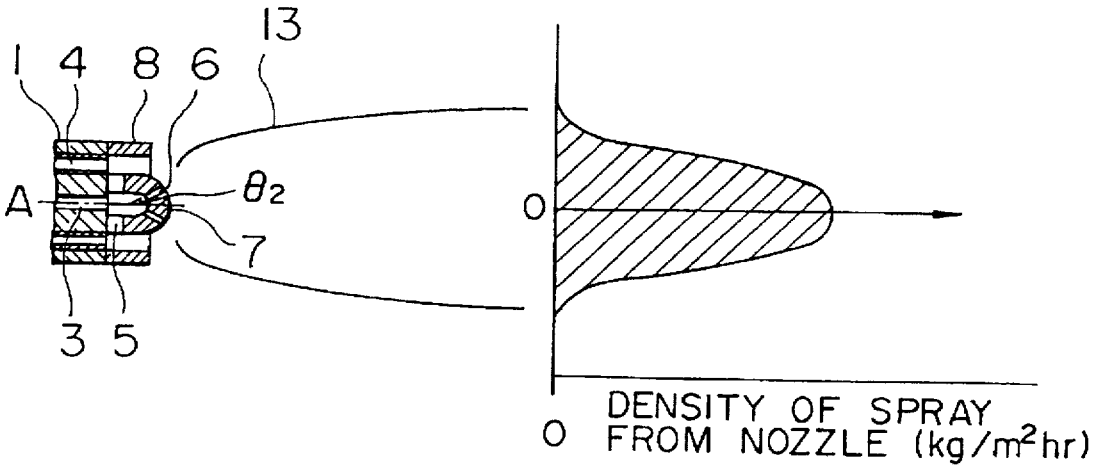
FIG. 3B shows the relationship between the flame shape and $\theta_2$ when $\theta_2$ is small.
Figure 4A:
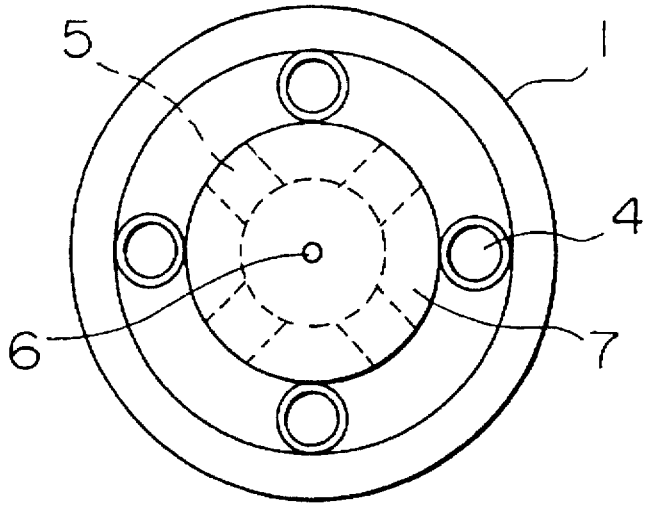
FIG. 4A shows a single port structure for the second oxygen-jetting ports.
Figure 4B:
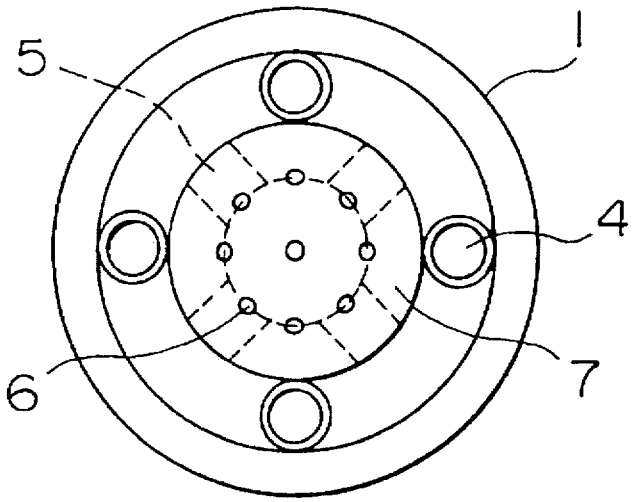
FIG. 4B shows a first multi-port structure for the second oxygen-jetting ports.
Figure 4C:
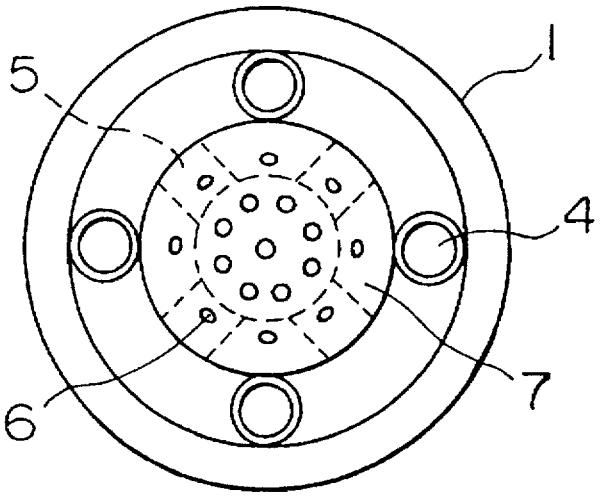
FIG. 4C shows a second multi-port structure for the second oxygen-jetting ports.

When the jet flow of the combustion flame and the fire-resisting material 11 is intended to be wide, the oxygen-jetting ports 6 are formed to make an angle $\theta_2$ of about 90° with the longitudinal axis A of the central passage 3. This is shown in FIG. 3A. When the jet flow 13 is intended to be narrow, the second oxygen-jetting ports 6 are formed substantially in parallel to the central passage 3 (i.e. $\theta_2$ is small), as shown in FIG. 3B. A variety of structures for the second oxygen-jetting ports 6 are shown in FIGS. 4A–4C. By adjusting the number of the second oxygen-jetting ports 6, the burner 1 can easily be adapted for specific repairs. For example, where the fire-resisting substance has to cover a wide damaged area, an arrangement as shown in FIG. 3A is employed. The nozzle cap 7 can be changed to repair areas with only local damage. Thus, the thermal spray repair on varying amounts of damage can be efficiently performed.

Furthermore, the following experiments confirm that adjusting the flow rate of oxygen colliding with the inner wall 12A of the burner tile 8 and the flow rate of oxygen directly supplied to the combustion flame by changing the opening area ratio of the nozzle will lengthen the lifetime of the burner 1. The burner 1 of this invention was subjected to thermal spray tests in such a manner that the ratio of the flow rates was varied. The results are shown in Table 1.

TABLE 1

| RATIO OF OXYGEN FLOW RATE (COLLISION OXYGEN/ DIRECT OXYGEN) | COLLISION OXYGEN OPENING AREA (PERCENT OF TOTAL OPENING AREA) | LENGTH OF FLAME (mm) | OCCURRENCE OF HOT-RED OXYGEN NOZZLE | DEPOSITION OF SPRAY MATERIAL TO OXYGEN NOZZLE |
|---|---|---|---|---|
| 0.5:1 | 33.3 | 200 | Non hot-red state | No Deposition |
| 1:1 | 50.0 | 130 | Non hot-red state | No Deposition |
| 5:1 | 83.3 | 100 | Non hot-red state | No Deposition |
| 10:1 | 90.9 | 100 | Non hot-red state | No Deposition |
| 20:1 | 95.2 | 80 | Non hot-red state | No Deposition |
| 50:1 | 98.0 | 75 | Non hot-red state | No Deposition |
| 100:1 | 99.0 | 70 | Non hot-red state | No Deposition |
| 200:1 | 99.5 | 60 | Became hot-red | Spray material deposited |

As can be understood from Table 1, when the flow rate ratio of the collision oxygen, i.e. the oxygen which is supplied through the first oxygen-jetting ports 5 and which collides with the inner wall 12A of the burner tile 8, to the direct oxygen, i.e. the oxygen directly supplied through the second oxygen-jetting ports 6, is 1:1, the ratio of mixture with fuel gas (propane) 3 is lowered. This ratio is obtained when the percentage of the total opening area, i.e. the sum of the areas of the first and second oxygen-jetting ports, which is provided to the first oxygen-jetting ports 5, i.e. collision-oxygen, is 50%. Therefore, the flame is excessively lengthened for use in the burner. When the ratio of the quantity of collision oxygen to direct oxygen is larger than 100:1 (the collision oxygen opening area percentage is 99%), the leading end 3A of the central passage 3 is made red-hot, and the spray material 11 adheres to the leading end 3A and the nozzle cap 7. Therefore, the burner 1 cannot be used for a long time. As a result, it is preferable, in this invention, that the collision oxygen opening area percentage, i.e. the area of the first oxygen-jetting ports 5, be between 50% to 99% of the total area for all of the first and second oxygen-jetting ports 5 and 6.

Numerous gases can be used as the fuel gas 10, such as, for example, natural gas, coke oven gas, blast furnace gas, or hydrocarbon gases, including propane or butane. The spray material is a fire-resisting material 11 in the form of powder, such as magnesia, silica, alumina or dolomite. The metal powder portion of the fire-resisting material 11 can include silicon, aluminum or magnesium. The oxygen-containing gas (the combustion-enhancing gas) can be air, as well as a gas containing a higher concentration of oxygen, or pure oxygen.

Figure 5:
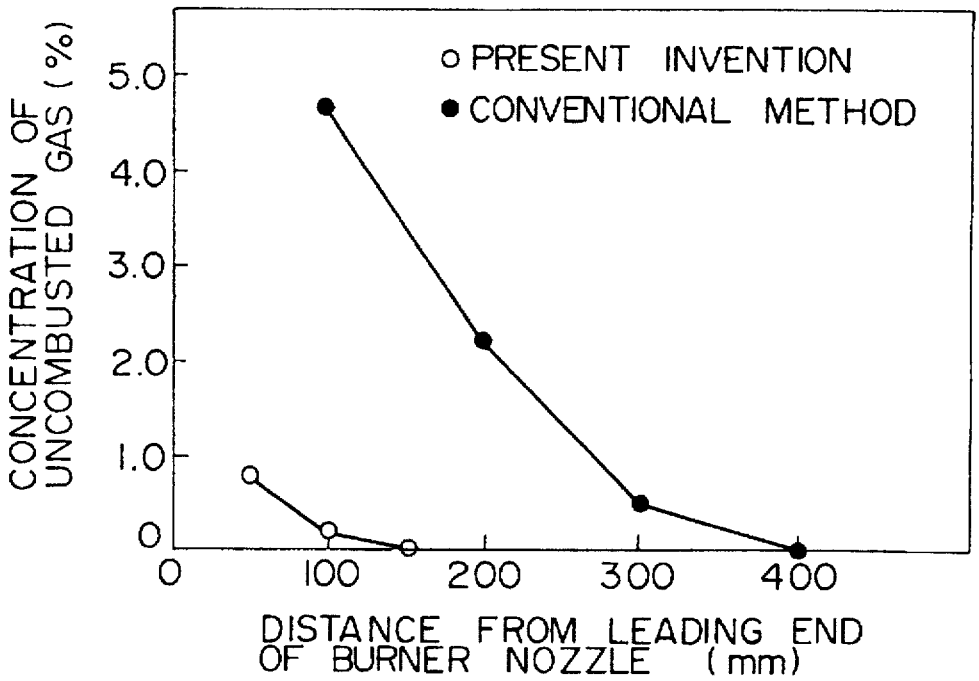
FIG. 5 shows the relationship between the concentration of uncombusted gas and the distance from the nozzle for the burners of this invention and the conventional burner.

An evaluation of flame lengths is shown in FIG. 5. An evaluation of temperature distribution is shown in FIG. 6.

Figure 6:
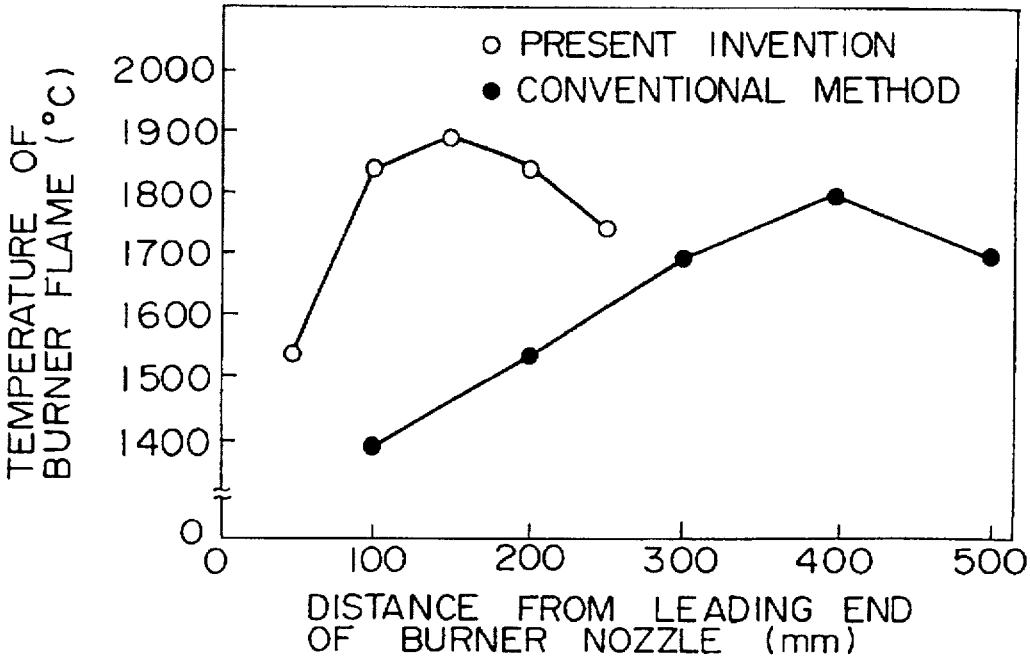
FIG. 6 shows the relationship between the flame temperature and the distance from the nozzle for the burners of this invention and the conventional burner.
Figure 8:
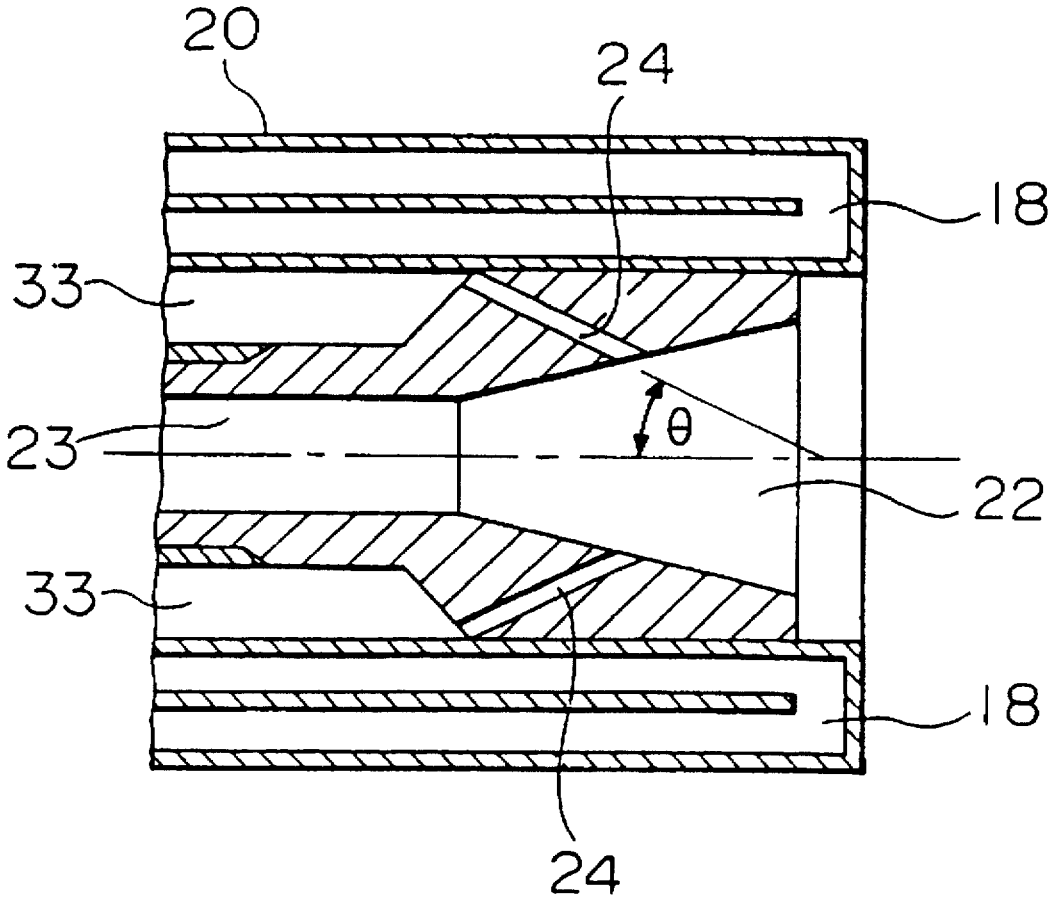
FIG. 8 PRIOR ART
FIG. 8 shows a conventional burner.

FIGS. 5 and 6 graph the results of measured temperatures in the flame and the quantity of the uncombusted fuel gas 10 attained with the conventional burner 20, shown in FIG. 8 and the burner 1 having θ=45°. The total quantities of uncombusted components (CO, $CH_4$, $C_mH_m$ and $H_2$) in the overall exhaust gas from combustion were plotted as the uncombusted gas. As FIG. 5 shows, the uncombusted gas disappears in the conventional burner only at a point of 400 mm distant from the leading end of the nozzle. In the burner 1, the uncombusted gas completely disappeared at a position only 150 mm from the leading end 3A of the nozzle. Thus, it can be understood that the flame length was shortened considerably.

The highest temperature of the flame was attained in each burner at the point at which the uncombusted gas disappeared, and is shown in FIG. 6. Since the flame of the burner 1 was longer than that of the conventional burner 20, the spread of the radiation could be restricted. Thus, the highest temperature obtainable by the burner 1 was higher than that of the conventional burner 20 by about 100° C. As a result, efficient mixture and combustion of the fuel gas 10 and the oxygen-containing gas 9 can be achieved.

Figure 7:
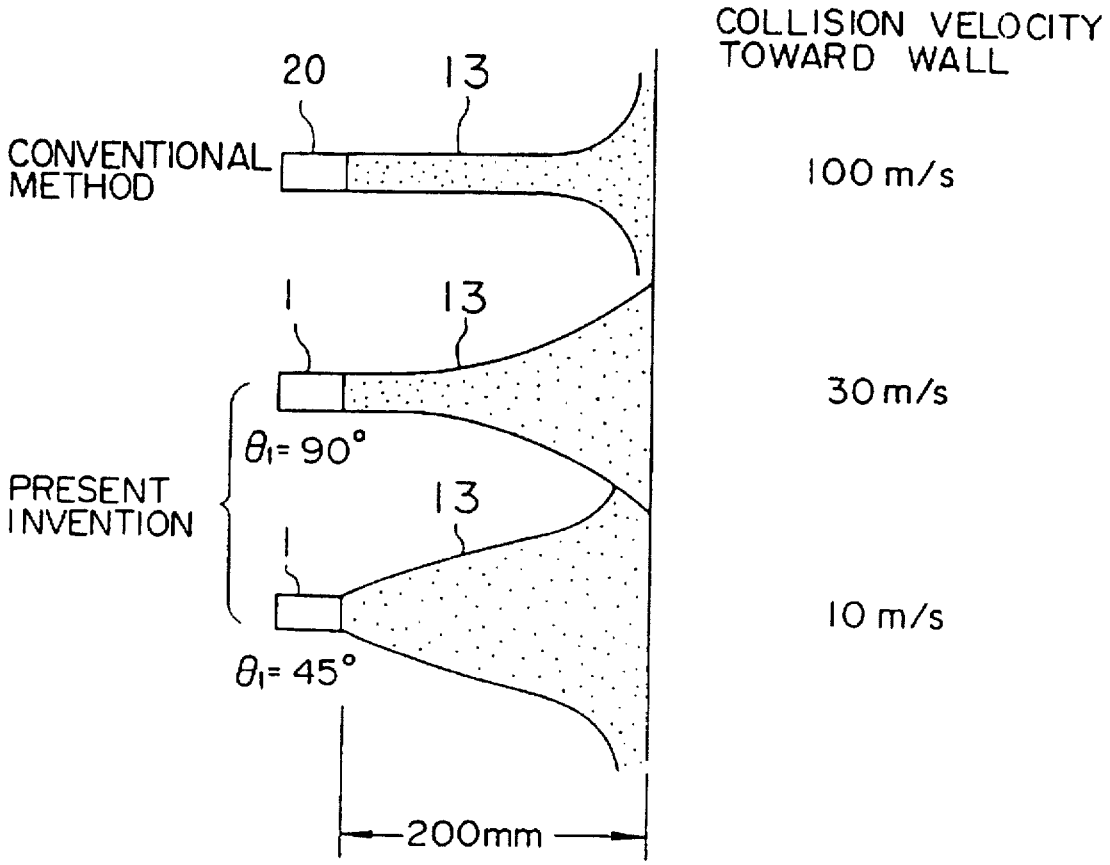
FIG. 7 shows the relationship between $\theta_1$, the distance from the nozzles and the shapes of the flames formed by the conventional burner and the burners of this invention.

An evaluation of the shapes of the flames is shown in FIG. 7. Table 2 lists the spray deposition efficiency realized when the oxygen burner 1 is used to repair a fire-resisting substance by thermal spray.

FIG. 7 graphically shows the results of observations of flame shapes performed where a fire-resisting wall was positioned 200 mm from the leading end 3A of each nozzle. As shown in FIG. 7, the conventional burner 20 formed a sharp flame 13 because oxygen was supplied from outside. This produces a considerably high collision velocity of the flame toward the wall of 100 m/s. On the other hand, the flame shape from the burner 1 was changed considerably by changing the angle $\theta_1$. This lowered the collision velocity to 30 m/s when the angle $\theta_1$ was 90°. When the angle $\theta_1$ was 45°, the collision velocity was further lowered to 10 m/s.

The deposition efficiencies in spraying the spray material from the conventional burner 20 and from the burner are shown in Table 2. As shown by Table 2, the burner 1 reduced the flame length and lowered the collision velocity toward the fire-resisting wall, so that the rebound loss of the spray material was reduced. Thus, the deposition efficiency was significantly improved.

TABLE 2

| | Conventional | Present Invention | |
|---|---|---|---|
| | Method | $\theta_1 = 90°$ | $\theta_1 = 45°$ |
| Deposition Efficiency | 62% | 92% | 96% |

The burner 1 was used to repair a damaged portion of a fire-resisting portion of a coke oven under the conditions shown in Table 3.

TABLE 3

| | |
|---|---|
| Distance from Surface of Fire-resisting Material to be Repaired (mm) | 150 mm |
| Component of Spray Material | Silica Brick Powder (Particle size 100–1000 μm) Metal silicone mixed by 15% |
| Spray Velocity (kg/hr) | 30 |

TABLE 3-continued

| | |
|---|---|
| Fuel Gas ($m^3$/hr) | Propane 6 |
| Oxygen ($m^3$/hr) | 50 |

The burner 1 included, as shown in FIG. 1A, a nozzle body 2 having a columnar member (having an outer diameter of 80 mm and a length of 3000 mm) made of SUS 310 and four supply passages 4, each having a diameter of 10 mm, and one central passage 3 having an inner diameter of 15 mm. The cylindrical burner tile 8 has an inner diameter of 60 mm and a length of 20 mm and is made of SUS 310. The nozzle cap 7 was attached to the leading end 3A of the central passage 3. The nozzle cap 7 has four vertical second oxygen-jetting ports 6, each having a diameter of 9 mm and eight first oxygen-jetting ports 5, having a diameter of 2 mm and making an angle $\theta_2$ of 45° with the longitudinal axis of the nozzle. The ratio of the flow rate of oxygen flowing toward the burner tile 8 and oxygen flowing toward the other portions was adjusted such that the opening area ratio of the two types of oxygen-jetting ports was 10:1.

The burner 1 was compared with the conventional burner 20 disclosed in Japanese Laid-Open Patent No. 59-60178 and shown in FIG. 8. The resulting deposition efficiency (deposition yield), strength of the deposited layer, and deposition of the spray material onto the nozzle are shown in Table 4. The desired value for the deposition strength is at least 250 kg/$cm^2$.

As shown in Table 4, the burner 1 has improved deposition efficiency of the spray material, greater strength of the deposited layer, and no deposition of the spray material on the burner 1.

TABLE 4

| TESTS | FIRST PREFERRED EMBODIMENT OF BURNER 1 | CONVENTIONAL BURNER |
|---|---|---|
| Deposition yield | 80–90% | 50–60% |
| Deposition Strength * (kg/$cm^2$) | 290–380 | 150–200% |
| Deposition of Spray Material to the Burner | No deposition | Thin layer was deposited to the leading end |

As described above, the burner 1 attains several advantages over the conventional burner 20. A short flame can be formed. Therefore, a thermal spray of the fire-resisting powder can easily be performed even in a narrow space, such as a coke oven, in which the conventional technology has encountered a difficulty. The deposition efficiency of the spray material is improved by the hot and wide flame. A significant deposition efficiency of the spray material can be realized, and a stronger sprayed layer can be formed. Furthermore, the lifetime of the nozzle can be increased.

Although this invention has been described in its preferred embodiments with a certain degree of particularity, it is understood that the present disclosure of the preferred embodiments can be changed in the details of construction and the combination and arrangement of parts without departing from the spirit and the scope of this invention as hereinafter claimed. Accordingly, the preferred embodiments of this invention as set forth herein are intended to be illustrative, not limiting.

What is claimed is:

1. A flame spraying burner for at least partially melting a spray material comprising a powdered fire-resisting material with combustion heat to thermally spray a damaged portion of an inner wall with the at least partially melted spray material, the flame spraying burner comprising:

a burner nozzle body having:

a central passage for supplying oxygen-contained gas and having a closed projecting leading end, a plurality of fuel gas supply passages formed around the central passage, each of the plurality of fuel gas supply passages having a leading end recessed from the projecting lead end of the central passage and sized for supplying a mixture of a fuel gas and the powdered fire-resisting material, and a plurality of oxygen-jetting ports formed in the projecting leading end to jet out oxygen contained gas in a radial direction from the central passage, and a cylindrical burner tile positioned around the leading ends of the fuel gas supply passages.

2. The flame spraying burner of claim 1, wherein each of the oxygen-jetting ports is formed at an angle between 45° and 90° to a longitudinal axis of the central passage.

3. The flame spraying burner of claim 1, wherein the projecting leading end of the central passage is a detachable nozzle cap.

4. A flame spraying burner for at least partially melting a spray material comprising a powdered fire-resisting material with combustion heat to thermally spray a damaged portion of an inner wall with the at least partially melted spray material, the flame spraying burner comprising:

a burner nozzle body having:

a central passage for supplying oxygen-contained gas and having a closed projecting leading end, a plurality of fuel gas supply passages formed around the central passage, each of the plurality of fuel gas supply passages having a leading end recessed from the projecting lead end of the central passage and sized for supplying a mixture of a fuel gas and the powdered fire-resisting material, a plurality of first oxygen-jetting ports are formed in the projecting leading end to jet out oxygen contained gas in a radial direction from the central passage, and a plurality of second oxygen-jetting ports are formed at a forward end of the projecting leading end, and a cylindrical burner tile positioned around the leading ends of the fuel gas supply passages.

5. A flame spraying burner according to claim 4, wherein the projecting leading end of said central passage having said first and second oxygen jetting-out ports is a detachable nozzle cap.

6. A flame spraying burner according to claim 4, wherein the opening area ratio of said first oxygen-jetting-out ports is 50% to 99% of that of all oxygen jetting-out ports.

7. A flame spraying burner according to claim 4, wherein said first oxygen-jetting-out ports are symmetrically disposed about the axis of said burner.

8. A flame spraying burner according to claim 4, wherein each of said first oxygen-jetting-out ports is formed between adjacent second oxygen-jetting-out ports.

* * * * *